US008012333B2

(12) United States Patent
Ward et al.

(10) Patent No.: US 8,012,333 B2
(45) Date of Patent: Sep. 6, 2011

(54) ALUMINIUM ALLOY SHEET WITH ROUGHENED SURFACE

(75) Inventors: John Andrew Ward, Leamington Spa (GB); Jonathan Ball, Alcester (GB); Martin Philip Amor, Cropredy (GB)

(73) Assignee: Novelis Inc., Toronto, Ontario (CA)

( * ) Notice: Subject to any disclaimer, the term of this patent is extended or adjusted under 35 U.S.C. 154(b) by 1825 days.

(21) Appl. No.: 10/483,684

(22) PCT Filed: Jul. 19, 2002

(86) PCT No.: PCT/GB02/03305

§ 371 (c)(1),
(2), (4) Date: Jun. 8, 2004

(87) PCT Pub. No.: WO03/008672

PCT Pub. Date: Jan. 30, 2003

(65) Prior Publication Data

US 2004/0232001 A1 Nov. 25, 2004

(30) Foreign Application Priority Data

Jul. 20, 2001 (GB) ..... 0117683.3

(51) Int. Cl.
*C25D 5/00* (2006.01)

(52) U.S. Cl. ..... 205/220; 205/213; 205/640

(58) Field of Classification Search ..... 205/80, 205/213, 640, 220

See application file for complete search history.

(56) References Cited

U.S. PATENT DOCUMENTS

| | | | | |
|---|---|---|---|---|
| 4,446,221 | A | 5/1984 | Herting et al. | |
| 4,578,156 | A * | 3/1986 | Plazter | 205/213 |
| 5,436,110 | A | 7/1995 | Coppens et al. | |
| 6,368,483 | B1 * | 4/2002 | Ball et al. | 205/106 |
| 6,487,969 | B2 * | 12/2002 | Chau et al. | 101/467 |

FOREIGN PATENT DOCUMENTS

| | | |
|---|---|---|
| DE | 2517812 | 10/1975 |
| DE | 19931915 | 1/2001 |
| FR | 2267888 | * 11/1975 |
| JP | 50-131635 | 10/1975 |
| JP | 50-138903 | 11/1975 |
| JP | 52-61140 | 5/1977 |
| JP | 8-283990 | 10/1996 |
| JP | 11-012796 | 1/1999 |
| JP | 2000-178767 | 6/2000 |
| WO | WO9919086 | 4/1999 |

OTHER PUBLICATIONS

English language Abstract of German Patent Publication No. 199 31 915, esp@cenet database, Jan. 18, 2001.

English language Abstract of Japan Patent Publication No. 09165687, Patent Abstracts of Japan published Jun. 24, 1997.

English language translation of German Patent Publication No. 25 17 812, Oct. 30, 1975.

Japanese Patent Office, Official Action dated Jul. 29, 2008 in Japanese Patent Application No. 2003-514932.

D.R. Lide, ed., CRC Handbook of Chemistry and Physics, Boca Raton, Ann Arbor and Boston, CRC Press, 1991, p. 4-36.

* cited by examiner

*Primary Examiner* — Harry D Wilkins, III
*Assistant Examiner* — Zulmariam Mendez
(74) *Attorney, Agent, or Firm* — Cooper & Dunham, LLP

(57) ABSTRACT

There is disclosed a process for producing an aluminium alloy sheet, which comprises subjecting a surface of the sheet to anodising conditions to form on the surface an aluminium oxide barrier layer of thickness 10 to 50 nm and treating the oxide layer with an aqueous solution of alkali to remove the layer, thereby leaving a roughened surface on the alloy sheet.

31 Claims, 7 Drawing Sheets

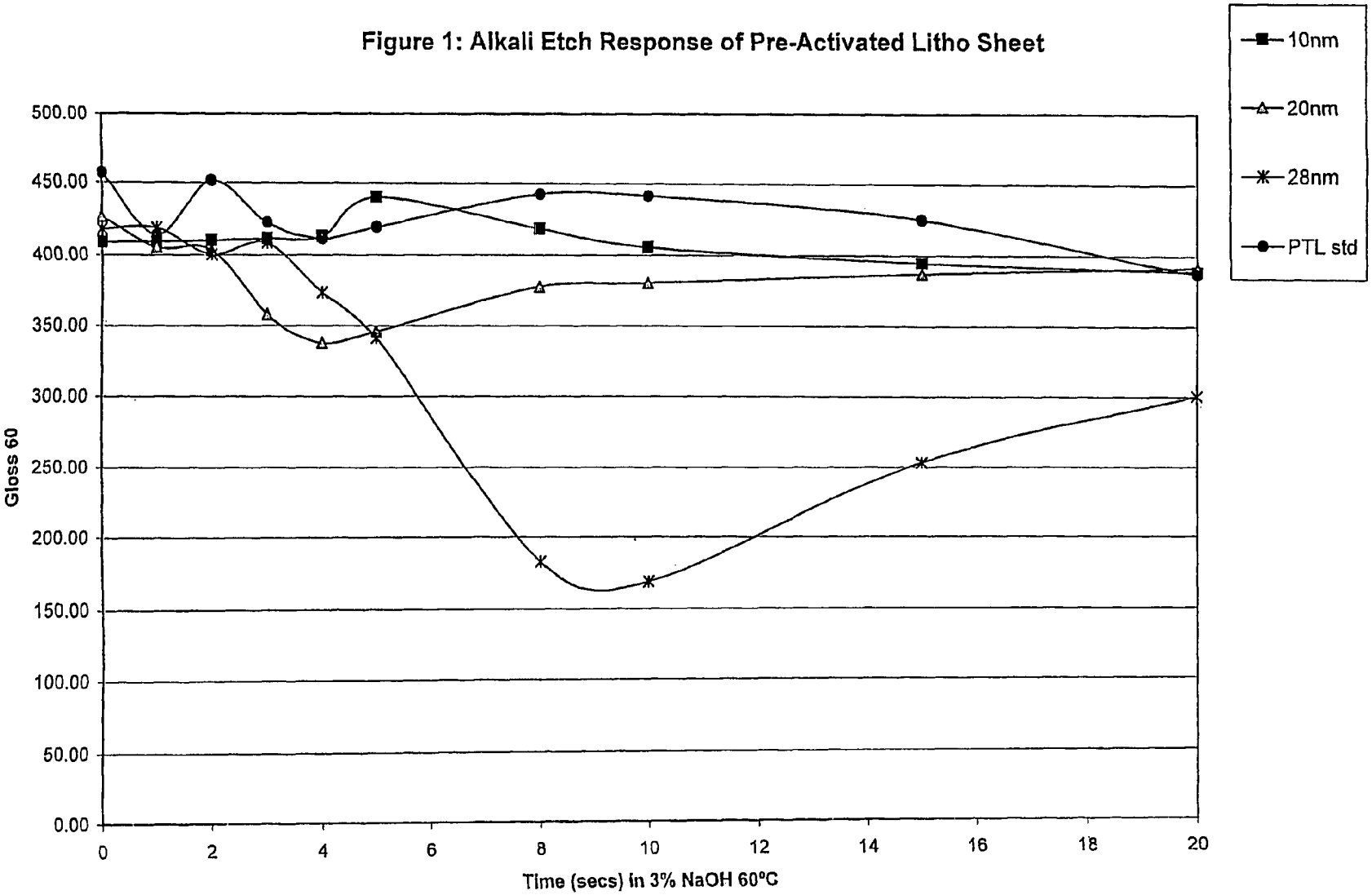
Figure 1: Alkali Etch Response of Pre-Activated Litho Sheet

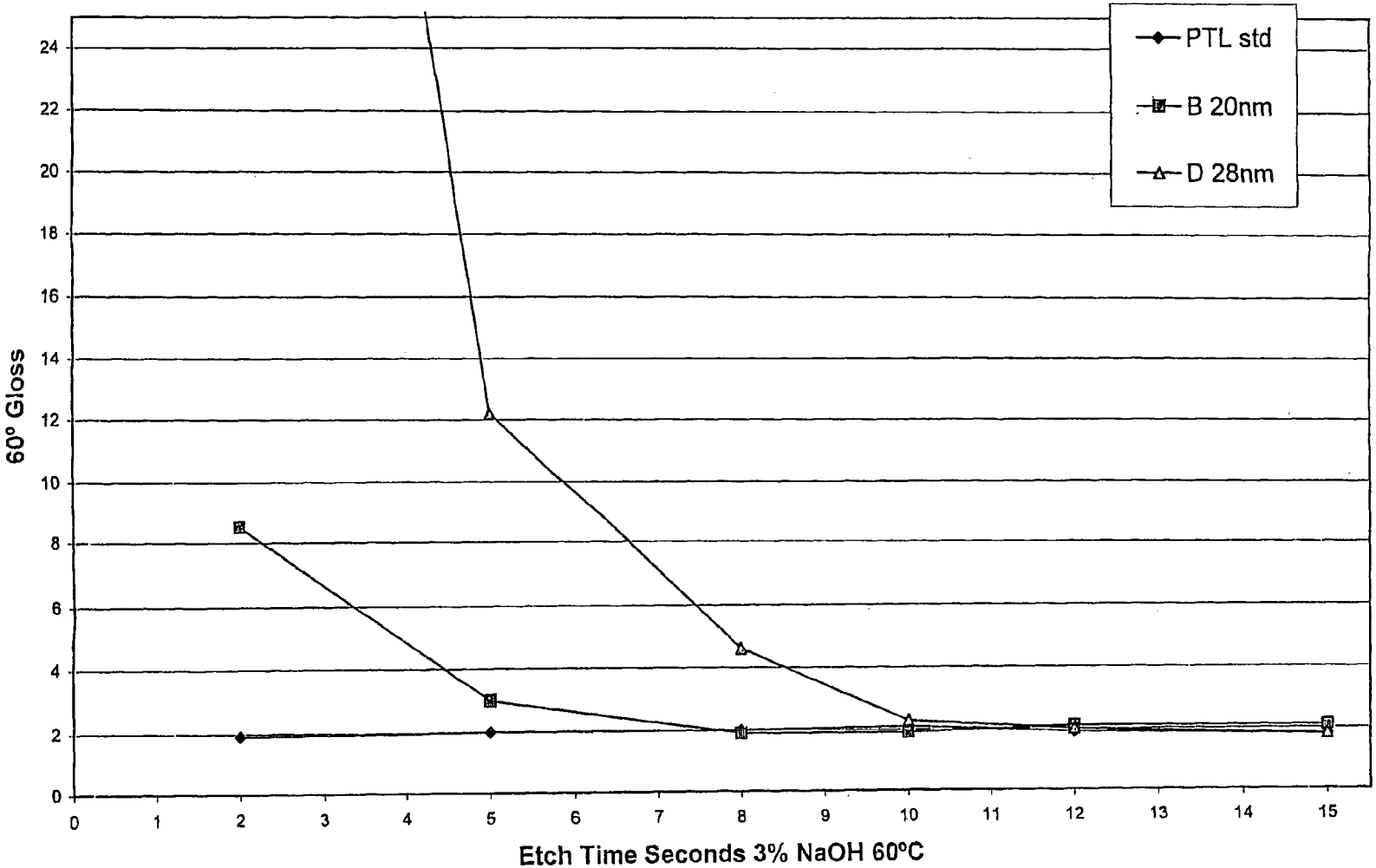
Figure 3: Gloss vs NaOh Etch Time 18s grain Nitric Acid

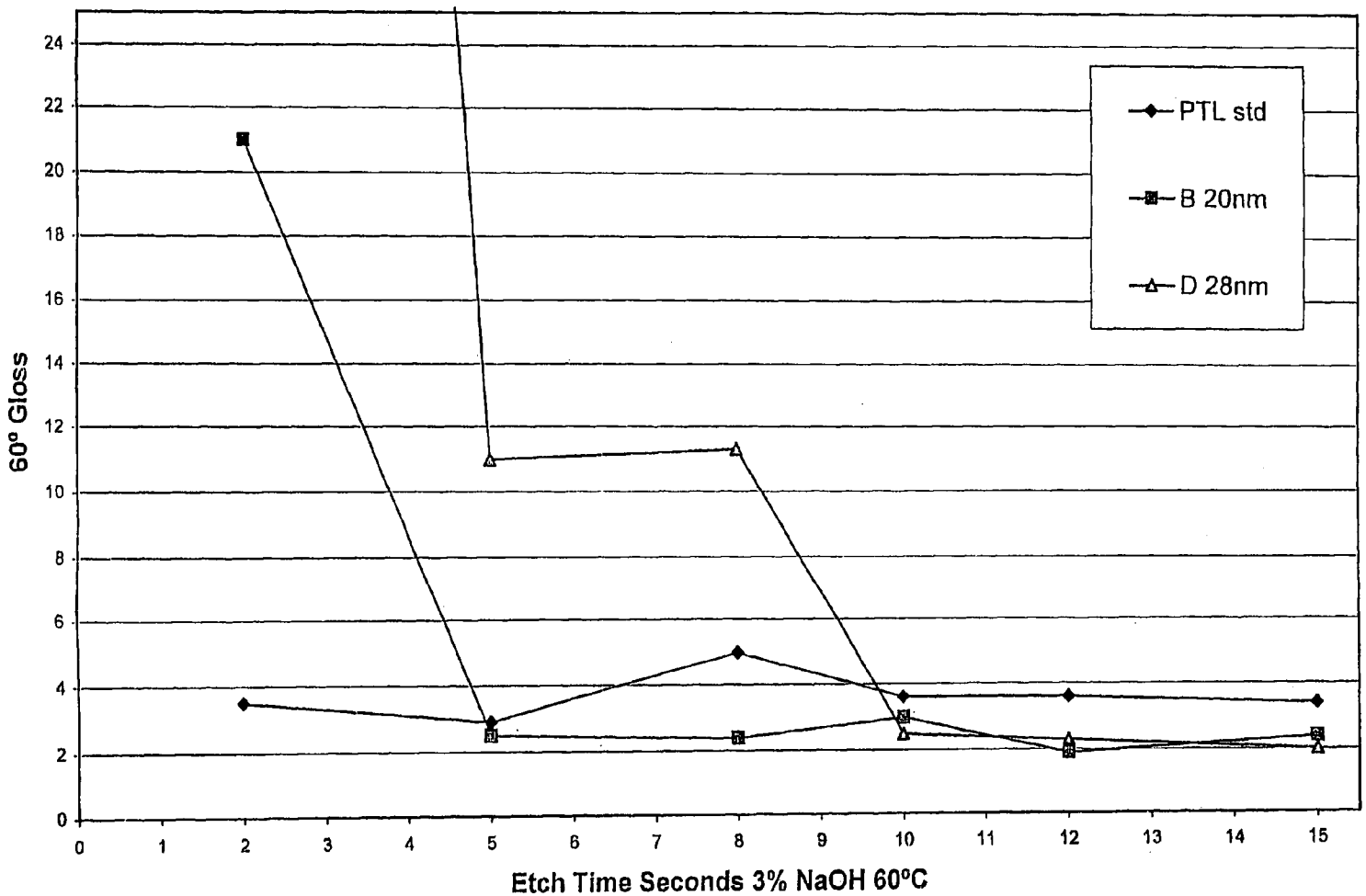
Figure 4: Gloss vs NaOH Etch Time 13s grain Nitric Acid

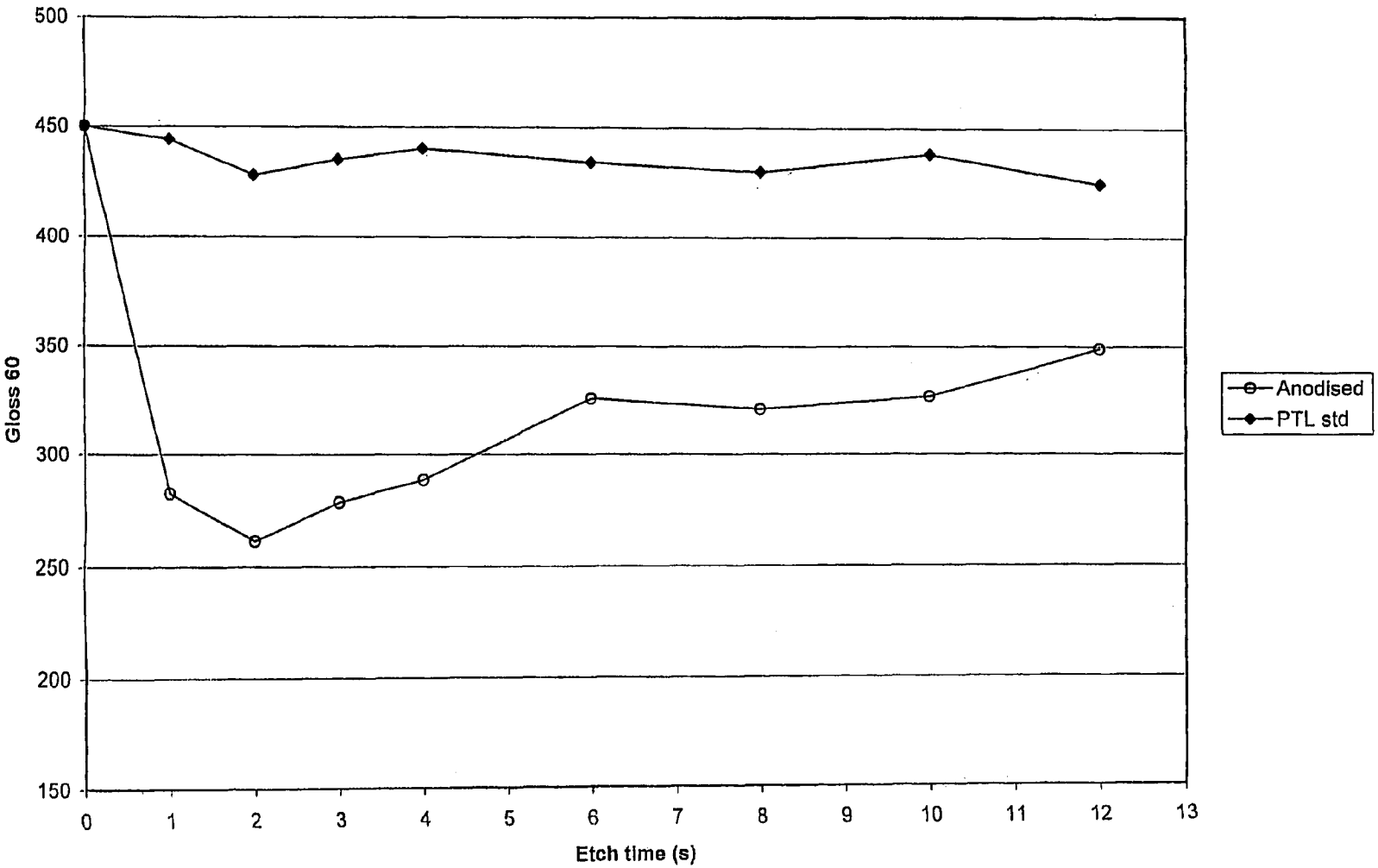
Figure 5: Gloss of PTL std and anodised material vs alkali etch time

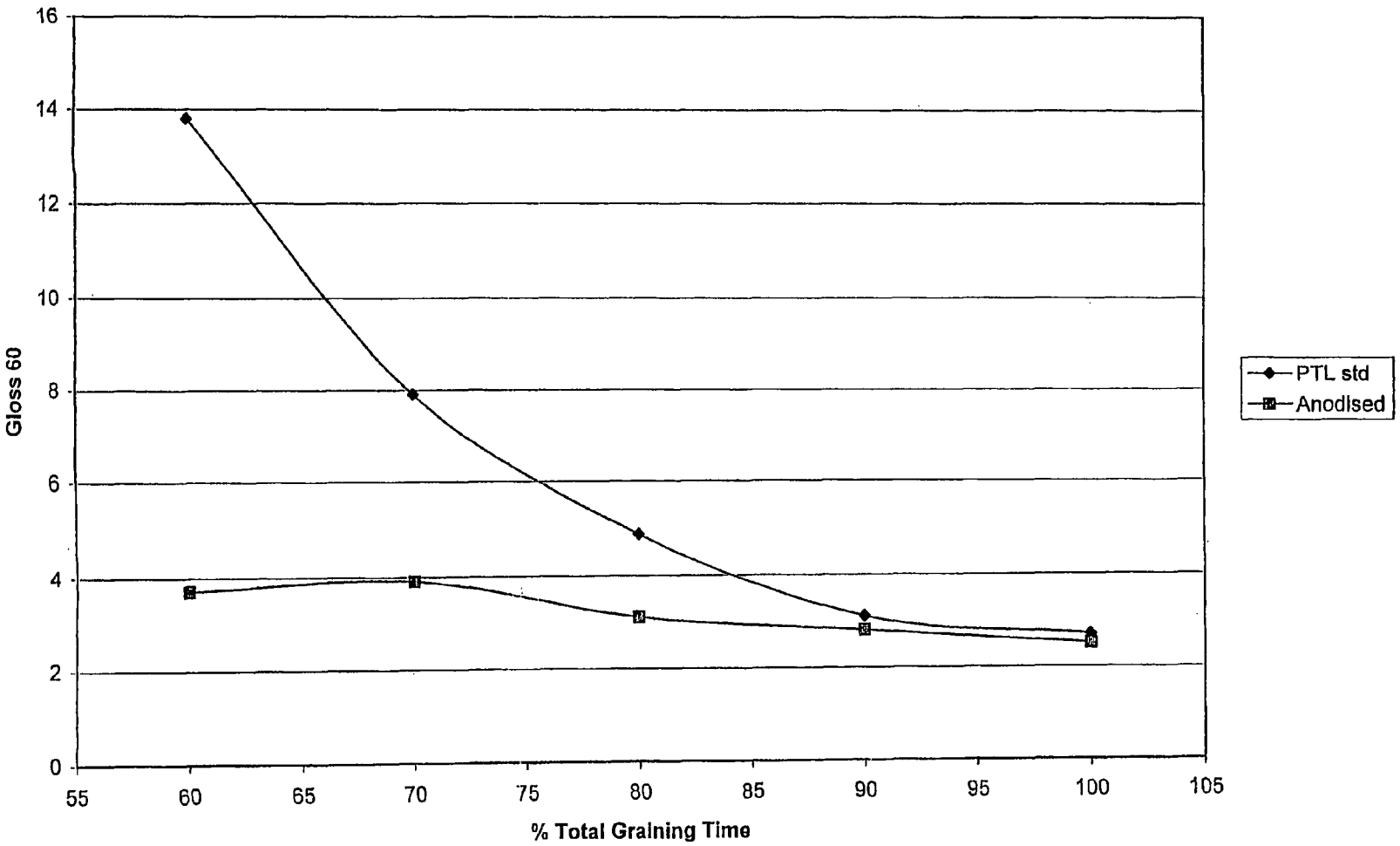
Figure 6: Gloss of PTL std and anodised material vs nitric acid electrograining time after 10s alkali etch

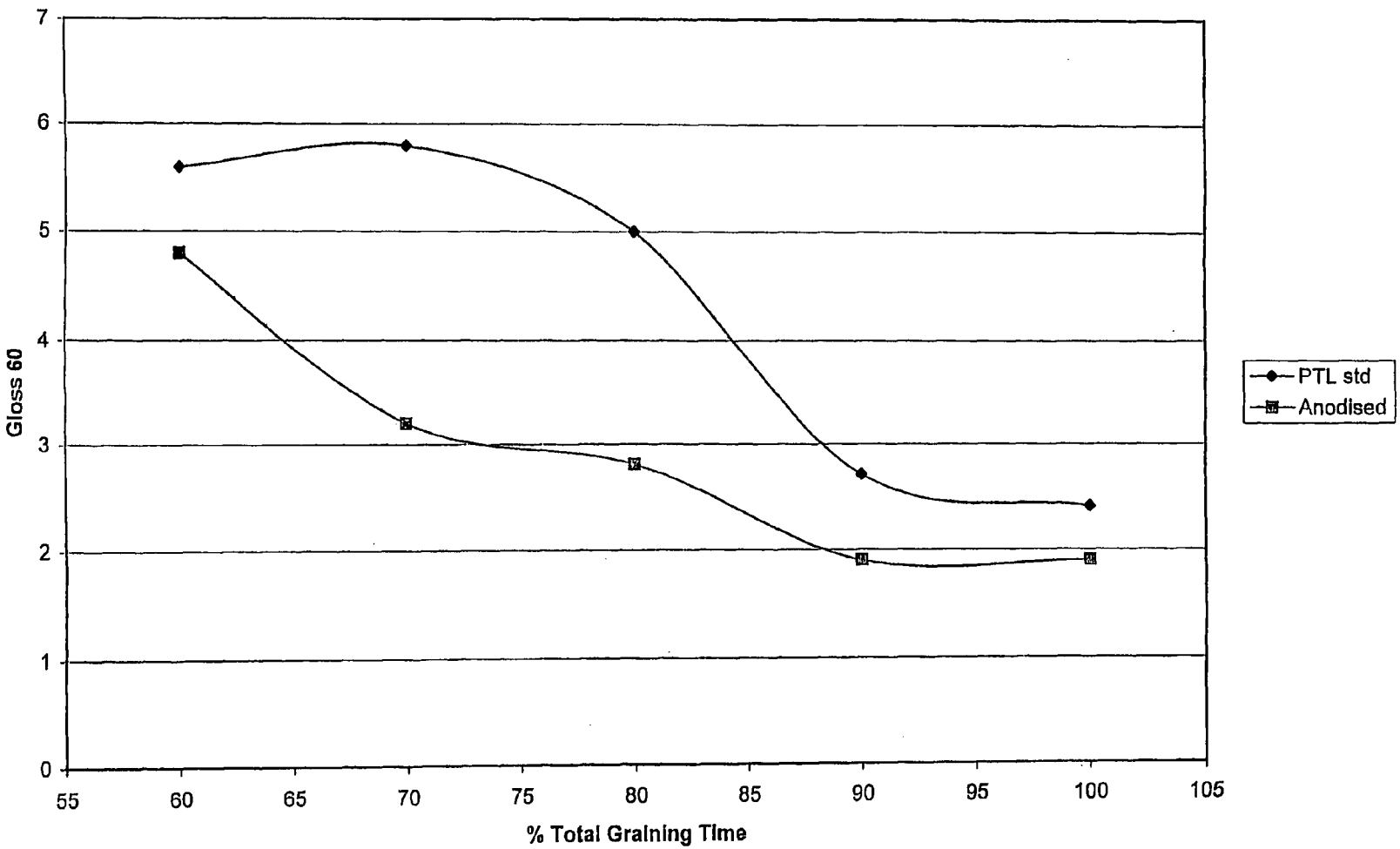
Figure 7: Gloss of PTL std and anodised material vs nitric acid electrograining time after 6s alkali etch

ALUMINIUM ALLOY SHEET WITH ROUGHENED SURFACE

The present invention relates to an aluminium alloy sheet material having a roughened surface. It also relates to a process for producing such a sheet material and to the use of such sheet materials. Such sheet materials are of particular use in the production of lithographic plates.

At present the lithographic sheet market largely consists of products in the AA1XXX and AA3XXX alloy range. An alloy sheet, being prepared for use as a lithographic material, is conventionally cleaned by the metal producer to remove excess oil, oxide and metal fines. The cleaned sheet is then usually chemically etched for a short time, typically 5 to 10 s, in alkali immediately prior to electrochemical etching (electrograining) in nitric or hydrochloric acid electrolytes by the plate manufacturer. The action of the pre-etch (chemical etch) removes any naturally-formed oxides on the surface of the alloy sheet to produce a fresh active aluminium surface which can then be roughened by electrograining. The fresh aluminium surface obtained by the conventional pre-etch procedure is relatively smooth and contains only shallow micropitting.

To make an aluminium sheet suitable for use as a lithographic plate support its surface needs to be roughened or grained in order to enhance the adhesion of an organic coating on the support, and to improve the water-retention properties. Application to the support of a photosensitive layer followed by irradiation and development generally results in a lithographic plate having ink-receptive image areas, which carry an organic coating, and water retaining non-image areas, the latter generally being the uncovered support surface. For this purpose the aluminium alloy sheet needs to be roughened on a scale of about Ra 1 to 2 μm as measured by an optical non-contact profilometer. This roughening is usually, though not necessarily, accomplished by electrograining. The present invention provides pre-anodising then etching prior to the steps of the standard graining process.

The cost of the graining or roughening step is an important part of the economics of lithographic plate support manufacture. In one aspect, the present invention is based on our discovery that roughening of an aluminium alloy surface can be achieved more economically than is achieved by the usual method involving a conventional pre-etch step.

Nitric acid electrograining is very susceptible to surface defects which can manifest themselves on the final lithographic printing plate. One such defect is known as non-etch defect. This appears as a bright ungrained streak which typically can be about 100 μm wide and several millimeters long. It is generally accepted in the art that the cause of non-etch defect is passivation during the electrograining process at the alloy surface. Passivation can be caused by local contaminating films, rolled-in metal, or rolled-in noble particles, e.g. of copper-rich material which cause local passivation. We have found that non-etch defects can be overcome or at least reduced by the present invention.

GB-A-2145738 discloses a process for anodising aluminium foil for electrolytic capacitors. A boehmite type film is produced and the foil is anodised in a phosphate electrolyte. The final foil has an anodic film which is, therefore, not totally removed.

EP-A-0645260 discloses a method of producing a support for a planographic printing plate comprising electrochemical roughening of an aluminium plate and etching with an alkali. No anodising step is disclosed.

U.S. Pat. No. 6,024,858 discloses a process for producing an aluminium support comprising chemical etching and electrochemical roughening. Anodising in an acidic solution is also disclosed but removal of the anodic film is not disclosed.

U.S. Pat. No. 5,731,124 discloses a method for preparing an aluminium foil comprising roughening and subsequent anodising. Subsequent washing with sodium bicarbonate is taught.

U.S. Pat. No. 5,556,531 discloses a process for the treatment of aluminium materials comprising treating an aluminium oxide layer with a solution of an alkali metal silicate and rinsing the treated layer. Such a treatment does not remove the oxide layer.

U.S. Pat. No. 5,282,952 discloses a method for preparing a substrate for lithographic printing plates. The process includes the step of anodising a plate, but there is not complete removal of the oxide layer.

U.S. Pat. No. 5,104,484 discloses a method for manufacturing a substrate for presensitised plates comprising electrolytic roughening and etching with an alkali or acid. The plate is anodised as a final step and the resulting film is not removed.

U.S. Pat. No. 4,980,271 discloses developer compositions for lithographic printing plates. Standard methods of preparing a plate by chemical or electrochemical graining and anodising are disclosed.

U.S. Pat. No. 4,689,272 discloses a treatment of aluminium oxide layers comprising treatment with an aqueous alkali and treatment of a separated oxide layer with an aqueous solution containing an organic polymer.

U.S. Pat. No. 4,545,866 discloses a modified electrograining process which includes a final conventional anodising step.

U.S. Pat. No. 4,492,616 discloses a process for treating aluminium oxide layers where an anodising step is the final step. The resulting layer is conditioned, but not removed.

U.S. Pat. No. 4,483,913 discloses a planographic printing plate. The anodic film thereon is conditioned, but not removed.

DE-A-3717757 discloses the production of a substrate for making a lithographic printing plate including graining, anodising and hydrophilising.

DE-A-3335440 discloses a process in which etching is carried out after applying a photochemical layer to the anodised plate.

Therefore, the methods disclosed in the prior art often disclose electrograining without pre-anodising and, where an anodic film is produced, it is not dissolved completely.

According to a first aspect, the present invention provides a process for producing aluminium alloy sheet having a roughened surface which process comprises the steps of (1) subjecting a surface of the aluminium alloy sheet to be treated to anodising conditions to form on the said surface an aluminium oxide barrier layer having a barrier layer thickness in the range of from 10 to 50 nm, and (2) treating the aluminium oxide barrier layer with an aqueous solution of alkali at a temperature of 35° C. to 80° C. for a period of time sufficient to remove entirely or substantially entirely said layer from the alloy surface thereby leaving a roughened surface on the alloy sheet.

If the layer is not removed entirely or substantially entirely from the surface, poor graining may result. Entire removal of the layer is preferred.

We have found that by anodising the alloy under controlled conditions to form an aluminium oxide barrier layer on the surface of the alloy sheet and then subjecting this to a chemical etch in aqueous alkali solution an alloy surface is produced which is pitted and roughened to a greater degree than a surface not previously provided with such an anodic barrier layer.

Although we do not wish to be bound by theory we believe that in the early stages of etching, the alkali etch attacks flaws in the anodic oxide layer with continued dissolution to the aluminium surface. On contact with the aluminium surface dissolution of the aluminium occurs under the anodic oxide layer on the alloy surface. Effectively, a 'well' is produced between the metal surface and the anodic oxide layer where local dissolution of the aluminium surface causes a relatively deep pit. Also, at the same time there is dissolution of the oxide layer and after a period of time this layer completely dissolves to leave a deeply micropitted, or roughened, surface on the alloy sheet. It will be appreciated that a process that comprises a chemical etch step which produces a surface of the alloy sheet which is more micropitted, or roughened, compared to a conventional etch has the advantage that the subsequent electrograining can be carried out for a shorter time period than is used conventionally.

The roughened surface of an aluminium sheet prepared by the process of the invention can then be treated in the conventional way, including the step of applying a photosensitive layer followed by irradiation and development, for use as a lithographic sheet.

BRIEF DESCRIPTION OF THE DRAWINGS

FIG. 1 is a graph plotting the relationship between etch time and 60° gloss value for the non-anodised sample and for the anodised samples of Example 2 below;

FIG. 3 is a graph plotting the relationship between NaOH etch time and 60° gloss values for samples electrograined for 18s as set forth in Table 8 below;

FIG. 4 is a similar graph plotting the relationship between NaOH etch time and 60° gloss values for samples electrograined for 13s as set forth in Table 8 below;

FIG. 5 is a graph plotting the relationship between etch time and 60° gloss for PTL standard and anodised material described in Example 7 below;

FIG. 6 is a graph plotting gloss of PTL standard and anodized material vs nitric acid electrograining time after 10s alkali etch as set forth in Tables 9 and 10 below; and FIG. 7 is a graph plotting gloss of PTL standard and anodised material vs. nitric acid electrograining time after 6s alkali etch as set forth in Tables 11 and 12 below.

DETAILED DESCRIPTION

Figure 2A:
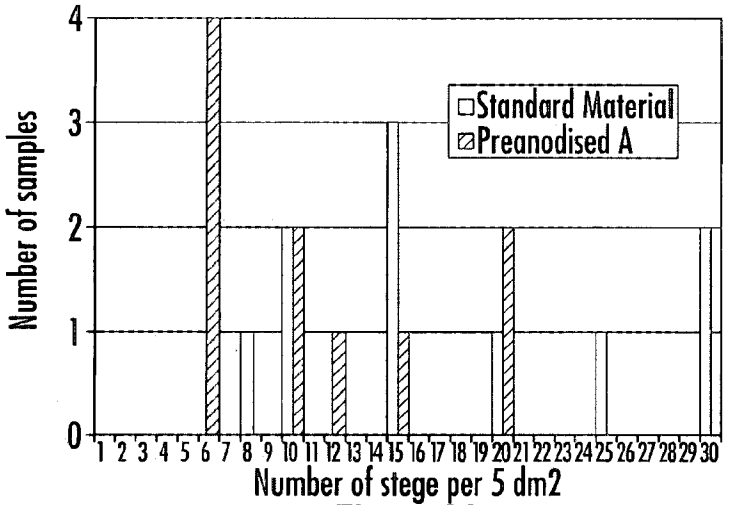
FIGS. 2A, 2B, 2C and 2D are graphs respectively showing numbers of non-etch defects (known as stege) for samples described in Example 5 below prepared as for anodising conditions A, B, C and D as described in Example 1 below.
Figure 2B:
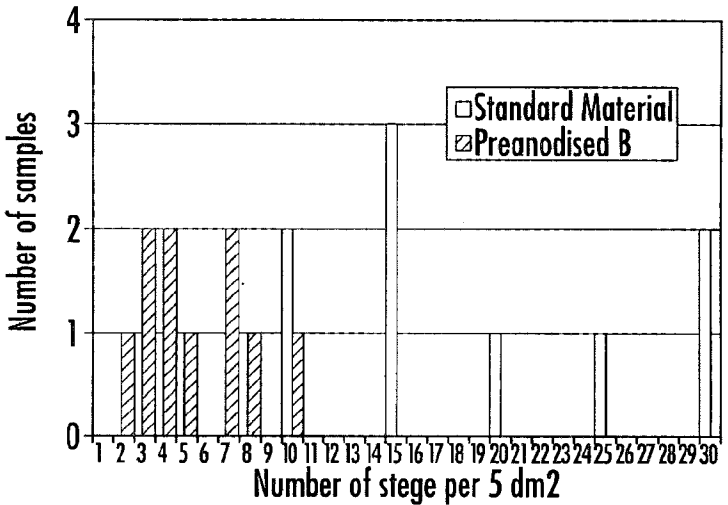
Figure 2C:
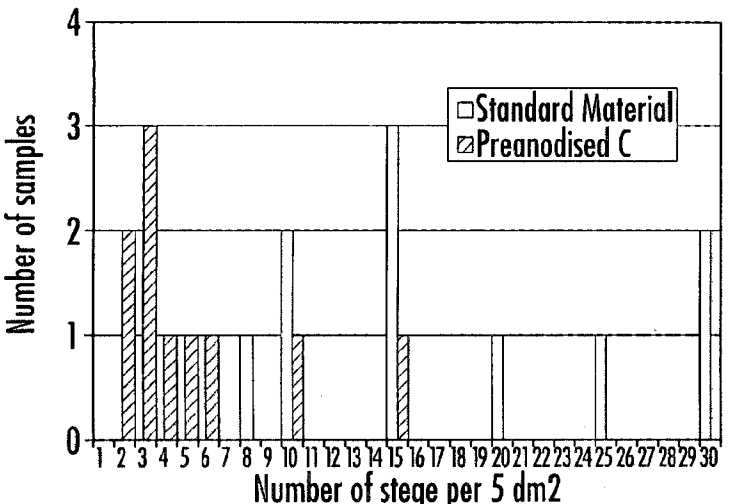
Figure 2D:
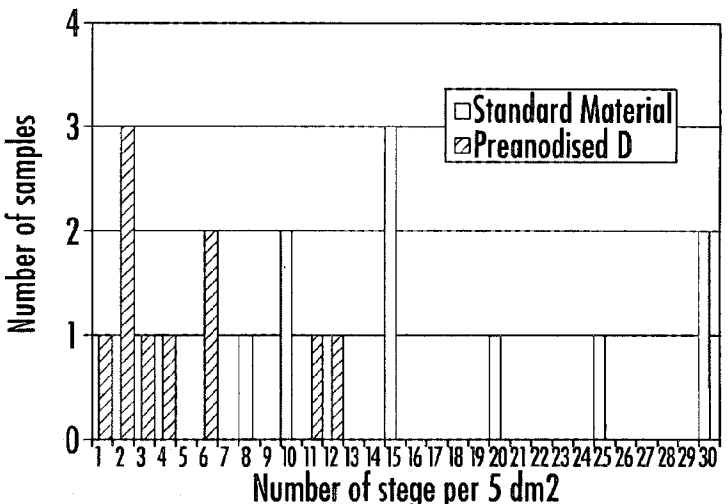

According to the present invention the aluminium alloy sheet is anodised to form, on its surface, an aluminium oxide barrier layer. The aluminium alloy will preferably be one selected from the AA1XXX or the AA3XXX alloy series. Examples of alloys that may be used in the present invention include AA1050A alloys, AA1200A alloys and AA3103 alloys which are preferred for lithographic use. In view of its better properties, particularly its good graining response, AA1050A alloy is most preferred.

Typically, the aluminium alloy sheet surface will be cleaned and anodised using phosphoric acid electrolyte to provide an aluminium oxide barrier layer having a layer thickness in the range of from 10 to 50 nm. By the term "aluminium oxide barrier layer" we mean an oxide layer which has barrier properties on the surface of the aluminium alloy sheet Preferably the layer will be non-porous. However, the layer may contain some pores provided that these do not compromise the barrier properties of the oxide layer. A porous oxide layer, which does not provide barrier properties, does not solve the technical problem which is solved by the use of an oxide layer having barrier properties.

The anodising procedure used in the process of the invention may use either direct current (d.c.) current or, more preferably, alternating current (a.c.). The a.c. waveform may be sinusoidal or not as desired. The a.c. current may be biased in either the cathodic or anodic direction. The a.c. frequency is at least several cycles per second and is, preferably, the commercial frequency.

The electrolyte concentration, the aluminium level of the electrolyte, the temperature, the current density and the time of anodisation all, of course, affect the thickness of the oxide layer produced. Typically, the phosphoric acid concentration will be within the range of 10 to 30%, with approximately 20% phosphoric acid being preferred in order to obtain a good compromise of the process parameters. It should be noted that other acids may be used to achieve the same effect, typical examples being nitric acid, sulphuric acid, or other phosphorus-containing acids. The electrolyte will contain aluminium typically up to about 20 g/l and preferably at a concentration in the range of from 3 to 15 g/l. The anodising treatment will typically be carried out using a solution at an elevated temperature, and typically at a temperature in the range of from 40° C. to 80° C., preferably 45° C. to 70° C. Anodising will typically be carried out using a current density of 1 to 5 $kAm^{-2}$, preferably 2 to 3 $kAm^{-2}$. The anodising treatment will typically be carried out for up to several seconds in order to produce an oxide layer having the desired layer thickness. We have found that oxide layers having a thickness range of from 10 to 28 nm can be produced by anodising in 20% phosphoric acid containing 3 to 15 $gl^{-1}$ aluminium at temperatures in the range of from 55° C. to 80° C. and current densities of from 2 to 3 $kAm^2$ for about 0.5 s. By way of example, the barrier films shown in the following Table 1 may be prepared by anodising AA1050A alloy sheet in 20% phosphoric acid containing about 8 $gl^{-1}$ aluminium.

TABLE 1

| Temperature ° C. | Current Density $kAm^{-2}$ | Barrier Film nm |
|---|---|---|
| 55 | 3 | 28 |
| 60 | 3 | 31 |
| 65 | 3 | 28 |
| 70 | 3 | 26 |
| 70 | 2 | 18 |
| 75 | 2 | 17 |
| 80 | 2 | 10 |

After the anodising stage the anodised aluminium alloy sheet may be stored or treated without substantial delay to the etching step. On the grounds that the anodised alloy sheet may, itself, be an item of commerce and that a sheet having a non-porous aluminium oxide layer having a barrier layer thickness in the range of from 10 to 50 nm, preferably 10 to 30 nm, for example 20 to 30 nm can be used to provide special benefits described herein the invention in a further aspect provides a sheet of aluminium alloy having on a surface thereof a non-porous aluminium oxide layer having a barrier layer thickness in the range of 10 to 50 nm, preferably 10 to 30 nm, for example 20 to 30 nm. The aluminium alloy is preferably one selected from AA1XXX and AA3XXX alloys as described above and most preferably AA1050A alloy. The invention according to yet a further aspect provides the use of a sheet of aluminium alloy having on a surface thereof a non-porous aluminium oxide layer having a barrier layer thickness in the range of from 20 to 30 nm in the manufacture of aluminium alloy sheet having a roughened surface which manufacture comprises treating the non-porous aluminium oxide layer with an aqueous solution of alkali at a temperature in the range of from 35° C. to 80° C. for a period of time sufficient to remove entirely or substantially entirely said layer from the alloy surface thereby leaving a roughened surface on the alloy sheet.

The anodised aluminium alloy sheet is then treated to a chemical etch using an aqueous solution of alkali of a temperature in the range of from 35° C. to 80° C. for a period of time sufficient to remove entirely or substantially entirely the aluminium oxide layer from the alloy surface thereby leaving a deeply micropitted, or roughened, surface on the alloy sheet.

The aqueous solution of the alkali, typically NaOH or KOH, preferably has a concentration by weight of from 1 to 10%. Most preferably, the alkali used in the etching step is 2 to 5% NaOH. The chemical etch will be carried out for a period of time sufficient to cause the complete removal of the aluminium oxide layer at which point the alloy surface will be roughened. Surfaces have been etched in sodium hydroxide solutions for varying amounts of time. The degree of micropitting obtained has been shown to depend on the etch time in the sodium hydroxide and on the thickness of the aluminium oxide layer on the anodised alloy sheet. The degree of micropitting increases with sodium hydroxide etch time to a point of maximum roughness and minimum gloss. This also depends on the barrier layer thickness. For example the roughness of the surface with a 20 nm barrier layer reaches its maximum and reaches lowest gloss after about 3 to 5 seconds in 3% NaOH at 60° C. A similar surface with 28 nm of barrier layer reaches a maximum roughness and lowest gloss after about 8 seconds. A surface with no barrier layer shows relatively smooth surfaces when similarly treated with no evidence of the type of micropits formed when a barrier layer is present on the surface of aluminium. Alkali etching past the point of lowest gloss begins to overcome any of the benefits described until, eventually, a surface similar to that obtained by etching a non-anodised starting material is obtained. The pitted surface is effectively smoothed by further alkali etching.

As mentioned above, the process of the invention which provides a roughened surface on aluminium alloy sheet gives rise to advantages when the sheet is subjected to electrograining according to conventional techniques. Firstly, because the alloy sheet produced according to the process described above has a surface which has greater roughness compared to standard treated alloy sheet a subsequent step of electrograining can be carried out for a shorter period of time (compared to the conventional technique) to provide a surface on the alloy having satisfactory graining. This shorter electrograining time provides a reduced consumption of chemicals and less costly waste. Accordingly, the present invention further provides a method of making an electrograined aluminium alloy sheet which comprises (1) subjecting a surface of a sheet of an aluminium alloy, preferably selected from AA1XXX and AA3XXX alloys, to anodising conditions to form on the said surface an aluminium oxide barrier layer having a barrier layer thickness of from 10 to 50 nm; (2) treating the aluminium oxide layer with an aqueous solution of alkali at a temperature of 35° C. to 80° C. for a period of time sufficient to remove entirely or substantially entirely said layer from the alloy surface thereby leaving a roughened surface on the alloy sheet, and (3) subjecting the roughened surface of the alloy sheet to electrograining.

Although electrograining may be carried out using nitric acid or hydrochloric acid in the present invention it is preferred that nitric acid electrograining is used. The conditions employed for the electrograining step of the process are those that are known in the art.

In the case of nitric acid electrograining the present invention also provides a means of reducing non-etch defects. As reported herein non-etch defects can be substantially reduced by use of an alloy sheet, as the feedstock for the nitric acid electrograining procedure, roughened by the process described herein.

According to a further aspect of the present invention, there is provided an aluminium sheet formed by the process of the invention for use as a lithographic substrate. Thus, aluminium alloy sheets roughened in accordance with the process of the invention may advantageously be used as substrates for additive grained plates. Additive graining is a procedure whereby at least one coating is applied to a cleaned and rolled surface to give the desired wear, hydrophilic and adhesion properties of the lithographic substrate. Such coatings may be transparent so a uniform appearance to the substrate is desirable both aesthetically and for operational purposes. The micropitted surfaces obtained by the invention will promote bonding to coatings applied to the alloy sheets and give a more uniform appearance to the substrate. Examples of such coatings include sol gel coatings or films that comprise a hydrophilic and a hydrophobic layer where the top layer can be removed, for example, by thermal ablation.

Furthermore, other uses of the aluminium sheet are envisaged, for example canstock, auto sheet, reflector sheet etc.

EXAMPLES

Example 1

Samples of AA1050A lithographic sheet were anodised using 20% phosphoric acid containing approximately 8 g/l Al for 0.5 s with the film thickness variation achieved by varying the a.c. current density and treatment temperature as shown in Table 2.

TABLE 2

| Temperature ° C. | 2 $kAm^{-2}$ | 3 $kAm^{-2}$ |
|---|---|---|
| 55 | | 28 nm (D) |
| 60 | | 31 nm |
| 65 | | 28 nm |
| 70 | 18 nm (B) | 26 nm (C) |
| 75 | 17 nm | |
| 80 | 10 nm (A) | |

The samples prepared above and as shown in Table 2 were treated with 3% NaOH at 60° C. for 10 s. For comparison a sample of AA1050A lithographic sheet similar to those anodised above was cleaned in phosphoric acid, but was not provided with an anodised layer and was treated to etching using the same etch conditions as were used for the other samples. The 60° gloss values of the treated surfaces were measured across the rolling direction using a Rhopoint glossmeter. The values are shown below in Table 3.

TABLE 3

| Oxide film nm | 0 10 (A) | 17 18 (B) | 26 (C) | 28 (D) | 31 28 |
|---|---|---|---|---|---|
| 60° Gloss | 429 401 | 332 318 | 167 | 149 | 147 157 |

60° Gloss Values of Surfaces Prepared in Table 2 After 10 s 3% NaOH etch 60° C.

As can be seen from Table 3, the samples having thicker aluminium oxide barrier layers gave, after the alkali etch, surfaces with lowest gloss values. Scanning Electron Microscopy (SEM) showed these alloy surfaces to be deeply micropitted when compared to the standard cleaned alloy surface (no anodised layer) after a similar alkali etch.

Example 2

A sample of lithographic alloy sheet AA1050A was cleaned in 20% phosphoric acid and then subjected to an alkali etch. Further samples of the same alloy sheet material were anodised as in Example 1 to produce non-porous aluminium oxide films of thickness 10, 20 and 28 nm. These were also subjected to an alkali etch. The alkali etch in all cases was carried out using 3% NaOH at 60° C. for up to 20 s. The gloss values of the alkali etched surfaces were measured, using a Rhopoint glossmeter, before etching and after etch times of 1, 2, 3, 4, 5, 8, 10, 15 and 20 seconds. Plots of the relationship between etch time and 60° gloss value for the non-anodised sample (PTL std) and for the anodised samples are shown in FIG. 1. A non-anodised sample that had been commercially cleaned electrolytically in phosphoric acid was included for comparison purposes (PTL std).

From FIG. 1 it can be seen that the level of gloss achieved depends on the thickness of the non-porous aluminium oxide layer and the degree of alkali etching. A thin anodised layer of 10 nm gives a similar response to the cleaned but not-anodised material. However, the sample having an aluminium oxide layer of 20 nm thickness reached a minimum 60° gloss value after 3-5 s etch time whereas the sample having an aluminium oxide layer of 28 nm reached a minimum 60° gloss value after about 8 s of etch time. The cleaned but non-anodised sample shows a relatively smooth surface throughout the etch period with no evidence of the type of, and degree of, micropitting obtained for samples originally provided with anodised layers.

It is clear from the results obtained that the degree of micropitting increases with etch time to a point of maximum roughness and minimum gloss. Alkali etching past the point of lowest gloss begins to reverse the benefits obtained until, eventually, a surface similar to that obtained with the non-anodised material is reached. The pitted surface is, thus, effectively smoothed by further alkali etching beyond the minimum gloss point.

The average roughness Ra of the surfaces of the samples at their minimum 60° gloss values achieved by etch was determined using a Perthen Focodyn or LS1 probe. These values are shown below in Table 4.

TABLE 4

| Thickness of Anodic Layer (nm) | Minimum 60° Gloss Value Achieved | Average Roughness Ra at Minimum Gloss (μm) | Alkali Etch Time to Minimum Gloss (s) |
|---|---|---|---|
| 0 | 400-450 | 0.35-0.40 | 0-20 |
| 10 | 400-450 | 0.35-0.40 | 0-20 |
| 20 | 330-350 | 0.45-0.50 | 3-5 |
| 28 | 160-180 | 0.45-0.52 | 8-10 |

Example 3

Experiments were carried out to investigate the time taken to achieve a satisfactory grained surface by electrograining samples of lithographic sheet (AM 050A).

Conventionally, before electrograining, lithographic sheet is typically etched in an alkali solution, such as 3% NaOH for 10 seconds at 60° C. This gives an etched surface with average roughness Ra between 0.35 and 0.4 microns and 60° gloss value of between 400 and 450. The purpose of this treatment is to remove a small amount of the surface and to activate it prior to electrograining. If this is not done, an unsatisfactory grained surface is produced.

In this example we subjected samples of 1050A sheet to electrograining in nitric acid. The samples were grained in a laboratory twin cell system operated in the liquid contact mode. The electrolyte was 1.5% nitric acid. The voltage applied was 14V a.c. (conventional sine wave source). The spacing between each electrode was 15 mm and the counter electrodes were conventional impregnated graphite used industrially. Due to the symmetrical nature of the arrangement the forward and reverse current density is approximately equal. The samples were:

1. AA1050A sheet precleaned in phosphoric acid and then etched for 10 s in 3% NaOH at 60° C.;
2. AA1050A sheet anodised according to the procedure described in Example 1 to produce a non-porous aluminium oxide layer having a thickness of 20 nm. This was then etched in 3% NaOH at 60° C. for 10 s; and
3. AA1050A sheet anodised according to the procedure described in Example 1 to produce a non-porous aluminium oxide layer having a thickness of 28 nm. This was then etched in 3% NaOH at 60° C. for 10 s.

In each case the surface of the sample was electrograined in 1.5% nitric acid at 40° C. and at 50 $Adm^{-2}$ for 10 s and the average roughness (Ra) and the 60° gloss value of the electrograined surface were determined as in Example 2. This procedure was repeated for electrograining times of 13, 15 and 18 s. The average roughness values of the samples after electrograining are shown in Table 5 and the 60° gloss values are shown below in Table 6.

TABLE 5

Ra Values of SurfacesAfter Different Electrograining Times

| Anodic Film Thickness Prior to Alkali Etch | 10 Second | 13 Second | 15 Second | 18 Second |
|---|---|---|---|---|
| 0 | 0.776 | 0.89 | 0.946 | 0.962 |
| 20 nm film | 0.893 | 0.999 | 0.985 | 0.981 |
| 28 nm film | 0.846 | 0.924 | 0.941 | 1.036 |

TABLE 6

60° Gloss Values of Surfaces After Different Electrograining Times

| Anodic Film Thickness Prior to Alkali Etch | 10 Second | 13 Second | 15 Second | 18 Second |
|---|---|---|---|---|
| Standard | 2.2 | 1.7 | 1.6 | 1.5 |
| 20 nm film | 1.8 | 1.5 | 1.4 | 1.3 |
| 28 nm film | 1.7 | 1.4 | 1.4 | 1.1 |

From these results it can be seen that surfaces with similar gloss and roughness can be obtained more quickly using etched pre-anodised surfaces having anodic layer thickness of 20 or 28 nm.

Example 4

Further electrograining experiments in the microcell system described in Example 3 with a range of electrograining conditions also showed electrograined surfaces can be obtained faster with pre-anodised surfaces. The sodium hydroxide pre-etch is as described above in Example 3. The results are shown below in Table 7.

TABLE 7

| | Electrograining Time (s) | | | | | | | | | | | | | | | |
|---|---|---|---|---|---|---|---|---|---|---|---|---|---|---|---|---|
| Anodic Layer | 14 V | | | | 13 V | | | | 12 V | | | | 11 V | | | |
| Thickness | 15 | 20 | 25 | 30 | 16 | 22 | 27 | 33 | 18 | 24 | 30 | 36 | 20 | 26 | 33 | 39 |
| 0 | X | / | O | O | X | / | O | O | X | / | O | O | X | X | O | O |
| 10 nm | X | / | O | O | X | / | O | O | X | / | O | O | X | / | O | O |
| 20 nm | X | / | O | O | X | O | O | O | X | O | O | O | X | / | O | O |
| 26 nm | X | O | O | O | X | O | O | O | X | O | O | O | X | / | O | O |
| 28 nm | X | O | O | O | X | O | O | O | X | O | O | O | X | O | O | O |

X = undergrained.
/ = reasonable graining.
O = good graining.

Normal electrograining in the microcell is considered to be 14 volts 30 seconds where a visually good structure is formed with the required pit morphology and roughness. Visually good graining is seen as early as 25 seconds. However, previous work on electrograining simulations have shown anything slightly less than 25 seconds can leave the surface slightly undergrained with insufficient coverage and roughness and the roll lines are still visible and too close to the borderline of the process. Therefore electrograining for 30 seconds overcomes any process variations from the alloy chemistry or any slight variations in the cleaning and electrograining process. The above table illustrates this and that even after 25 seconds the surface is visually good with all material including standard AA1050A. The above table shows that good surfaces can be obtained faster at certain graining conditions with pre-anodised surfaces and that benefits were apparent with a range of thickness between 10 and 30 nm. However, it is clear that fewer benefits were found with alloy sheet samples originally provided with 10 nm anodic film or less (before etch) and more benefits were found with the 28 nm anodic film alloy sheet.

Example 5

Samples from a 'worst ever' non-etch defect coil of AM1050A sheet were prepared as for anodising conditions A, B, C and D as described in Example 1. These were then etched in 3% NaOH for 10 s at 60° C. and electrograined in a laboratory tank in 1.5% nitric acid at 50 $Adm^{-2}$ at 40° C. for 13 s. The number of non-etch defects (known as stege) were counted and the results are shown in FIGS. 2A, B, C and D. In each case the results are also shown for a non-etch defect count taken on the standard material, i.e. un-anodised (PTL std) material but subjected to the same etch and electrograining procedures described above for the anodised materials.

As can be seen from the Figures, the number of non-etch defects was seen to decrease by about 40% with sample A (pre-anodised with 10 nm layer) and about 70% with samples B, C and D (pre-anodised with 20 nm, 26 nm and 28 nm layers, respectively).

Example 6

Nitric Acid Electrograining Studies of Alkali Etched Pre-Anodised AA1050A Lithographic Sheet Standard PTL cleaned, pre-anodised samples as prepared in B (20 nm) and D (28 nm) in Example 1 were etched in 3% NaOH at 60° C. for 2, 5, 8, 10, 12 and 15 seconds followed by rinsing in deionised water. All samples were electrograined at 50 $Adm^{-2}$ in 1.5% nitric acid at 40° C. for 10, 13, 15 and 18 seconds. A 10 second alkali etch and 18 seconds electrograining represents a full treatment with normal commercially cleaned litho sheet in the laboratory tank. The following 60° C. gloss values in Table 8 were measured and give an indication of the degree of graining.

TABLE 8

| 60° C. Gloss Values of Surfaces After Electrograining | | | | | | | |
|---|---|---|---|---|---|---|---|
| E/g t | std | B | D | E/g t | std | B | D |
| 2s NaOH | | | | 5s NaOH | | | |
| 5 | 20.2 | 184 | 250 | 5 | 8.6 | 13.5 | 27 |
| 10 | 7.1 | 90 | 142 | 10 | 4.4 | 7.6 | 8.3 |
| 13 | 3.5 | 21 | 115 | 13 | 2.9 | 2.5 | 11 |
| 15 | 2.8 | 26 | 110 | 15 | 2.3 | 1.9 | 10.3 |
| 18 | 1.9 | 8.5 | 64 | 18 | 2 | 3 | 12.2 |
| 8s NaOH | | | | 10s NaOH | | | |
| 10 | 4.6 | 5.3 | 24 | 10 | 3.8 | 3.6 | 4.3 |
| 13 | 5 | 2.4 | 11.3 | 13 | 3.6 | 3.2 | 2.5 |
| 15 | 2 | 2 | 3.2 | 15 | 3.2 | 2.8 | 4 |
| 18 | 2 | 1.9 | 4.6 | 18 | 2.1 | 1.9 | 2.3 |
| 12s NaOH | | | | 15s NaOH | | | |
| 10 | 5.5 | 3.6 | 4.7 | 10 | 4.4 | 3.7 | 4.2 |
| 13 | 3.6 | 1.9 | 2.3 | 13 | 3.4 | 2.4 | 2 |
| 15 | 2.1 | 2 | 2 | 15 | 1.9 | 2.9 | 1.9 |
| 18 | 1.9 | 2.1 | 2 | 18 | 1.8 | 2.1 | 1.8 |

std = sample with no pre-anodised layer but commercially cleaned, a value ≦ 2 indicates that the surface has been fully grained.
E/g t = electrograining time in seconds.

From the results above we have plotted the relationship between NaOH etch time and 60° gloss values for samples electrograined for 18 s. This is shown in FIG. 3. It is clear from this that the level of electrograining is relatively independent of alkali etch time for a normal PTL cleaned lithographic sheet (i.e. non pre-anodised). It is also evident that a minimum etch time is necessary when electrograining the pre-anodised sheet.

Examination of a similar plot produced for the samples electrograined for 13 s (FIG. 4) shows that the pre-anodised surfaces give lower gloss levels than the PTL standard (non pre-anodised) material for alkali etch times of at least 5 s for B and 10 s for D. They have similar surfaces to normal PTL cleaned material grained for 18 s.

From these results it is possible to obtain the required matt surface with similar gloss levels faster with pre-anodised surfaces if the alkali etch conditions are correct. For example if we choose an 8 second etch it may be sufficient for a 20 nm barrier film as the 28 nm film shows no benefits and is, in fact, worse than the normal material. If the alkali etch time is increased to 12 seconds this is where benefits in graining are seen with both 20 and 28 nm films. A further increase to 15 seconds indicates any benefits associated with the 20 nm film are reduced.

Example 7

1050A lithographic sheet was electrolytically cleaned in 20% phosphoric acid at 85° C. with a charge density of about 1 kC/m$^2$. It was then subject to an alkali etch (approximately 3% sodium hydroxide) at 60° C. for up to 12 seconds. Further samples of this same electrolytically cleaned starting material were anodised to give an 18 nm film as shown in sample B in Example 1. These were also subject to an alkali etch for up to 12 seconds. A plot of the relationship between etch time and 60° gloss are shown in FIG. 5. A non anodised sample cleaned electrolytically in phosphoric acid was included for comparison purposes (PTL standard). From FIG. 5 it can be seen the level of gloss achieved for the anodised sample depends on alkali etch time. A minimum 60° gloss value was achieved between 2-4 seconds.

Experiments were then carried out to investigate the time taken to achieve a satisfactory grained surface by electrograining samples of lithographic sheet with the above mentioned samples having an 18 nm film and standard PTL material.

Conventionally with this test the sheet is etched for 10 seconds in the alkali etch. Standard and anodised material was subject to this treatment followed by anodising in nitric acid for 14, 16, 18, 21 and 23 s representing 60, 70, 80, 90 and 100% graining.

The samples were visually examined and the anodised samples grained at 18 and 21 s were visually comparable to that of standard material grained for 23 seconds. For the same shorter graining times of 18 and 21 s, samples of standard material had a more metallic and variable appearance. Electrograining in batch processes with nitric acid can give some unevenness in surfaces. The samples produced showed anodised samples to have a faster and more even graining response. The results are illustrated in tables 9 and 10 below and gloss values in FIG. 6.

The same experiments were repeated with a 6 second alkali etch treatment which is close to the minima time as shown in FIG. 5. Again the samples were visually examined and the anodised samples grained at 18 and 21 s were visually comparable to that of standard material grained for 23 seconds. The samples of standard material grained for the same shorter times had a more metallic and variable appearance. The results are illustrated in tables 11 and 12 below and gloss values in FIG. 7.

TABLE 9

60° C. Gloss Values for 10 Seconds Alkali Etch With Anodised Sample

| Electrograining Time (s) | % graining | min | max | mean | sd |
|---|---|---|---|---|---|
| 23 | 100 | 2.2 | 2.7 | 2.5 | 0.16 |
| 21 | 90 | 2.3 | 3.3 | 2.8 | 0.35 |
| 18 | 80 | 2.1 | 3.7 | 3.1 | 0.49 |
| 16 | 70 | 3.1 | 5 | 3.9 | 0.68 |
| 14 | 60 | 2.9 | 4.5 | 3.7 | 0.52 |

TABLE 10

60° C. Gloss Values for 10 Seconds Alkali Etch With Standard Sample

| Electrograining Time (s) | % graining | min | max | mean | sd | |
|---|---|---|---|---|---|---|
| 23 | 100 | 2.3 | 3.3 | 2.7 | 0.38 | |
| 21 | 90 | 2.3 | 4.7 | 3.1 | 0.75 | |
| 18 | 80 | 3.6 | 7.3 | 4.9 | 1.13 | |
| 16 | 70 | 3.8 | 12.9 | 7.9 | 3.4 | variable graining |
| 14 | 60 | 4.2 | 24.1 | 13.8 | 6.8 | variable graining |

TABLE 11

60° C. Gloss Values for 6 Seconds Alkali Etch With Anodised Sample

| Electrograining Time (s) | % graining | min | max | mean | sd |
|---|---|---|---|---|---|
| 23 | 100 | 1.8 | 2.1 | 1.9 | 0.12 |
| 21 | 90 | 1.8 | 2.2 | 1.9 | 0.13 |
| 18 | 80 | 2.2 | 4.6 | 2.8 | 2.75 |
| 16 | 70 | 2.4 | 8 | 3.2 | 1.8 |
| 14 | 60 | 2.4 | 12.1 | 4.8 | 2.91 |

TABLE 12

60° C. Gloss Values for 6 Seconds Alkali Etch With Standard Sample

| Electrograining Time (s) | % graining | Min | max | mean | sd | |
|---|---|---|---|---|---|---|
| 23 | 100 | 2.2 | 2.8 | 2.4 | 0.2 | |
| 21 | 90 | 2.3 | 3 | 2.7 | 0.21 | |
| 18 | 80 | 3 | 12.7 | 8.1 | 3.2 | variable graining |
| 16 | 70 | 4 | 9.2 | 5.8 | 1.5 | variable graining |
| 14 | 60 | 3.7 | 11.5 | 5.6 | 2.4 | variable graining |

The invention claimed is:

1. A process for producing aluminium alloy sheet having a roughened surface which process comprises the steps of (1) subjecting a surface of the aluminium alloy sheet to be treated to anodising conditions to form on the said surface an aluminium oxide barrier layer having a barrier layer thickness in the range of from 10 to 50 nm, and (2) treating the aluminium oxide layer with an aqueous solution of alkali at temperature of 35° C. to 80° C. for a period of time sufficient to remove entirely said layer from the alloy surface thereby leaving a roughened surface on the alloy sheet.

2. A process according to claim 1, wherein the aluminium alloy sheet is a sheet of alloy selected from AA1XXX and AA3XXX.

3. A process according to claim 2, wherein the aluminium alloy sheet comprises a sheet of AA1050A, AA1200A or AA3103 alloy.

4. A process according to claim 1, wherein in step (1) the aluminium alloy sheet is anodised using 20% phosphoric acid containing from 3 to 15 $gl^{-1}$ aluminium at a temperature in the range of from 55° C. to 80° C. using a current density in the range of from 2 to 3 $kAm^{-2}$.

5. A process according to claim 1, wherein a.c. anodising is used.

6. A process according to claim 1, wherein d.c. anodising is used.

7. A process according to claim 1, wherein the layer thickness of the aluminium oxide barrier layer produced on the surface of the aluminium alloy sheet is in the range of from 10 to 50 nm.

8. A process according to claim 7, wherein the layer thickness of the aluminium oxide barrier layer produced on the surface of the aluminium alloy sheet is in the range of from 20 to 30 nm.

9. A process according to claim 1, wherein the aluminium oxide barrier layer is non-porous.

10. A process according to claim 1, wherein in step (2) the aqueous solution of alkali is selected from aqueous NaOH and aqueous KOH.

11. A process according to claim 10, wherein the aqueous solution of alkali has a concentration in the range of from 1 to 10%.

12. A process according to claim 11, wherein the aqueous solution of alkali is 2 to 5% NaOH.

13. A process according to claim 1, wherein in step (2) the treatment is carried out for a period within the range of from 3 to 20 seconds.

14. A process according to claim 1, wherein the aluminium alloy sheet is a sheet of AA1050A alloy and the surface of the alloy is treated to anodising conditions to form, on the said surface, a non-porous aluminium oxide layer having a layer thickness in the range of from 10 to 30 nm and wherein the aluminium oxide layer is treated, in step (2), with 3% aqueous NaOH at 60° C. for from 3 to 8 seconds.

15. A method of making a grained aluminium alloy sheet which comprises (1) subjecting a surface of a sheet of an aluminium alloy, to anodising conditions to form on the said surface an aluminium oxide barrier layer having a barrier layer thickness of from 10 to 50 nm; (2) treating the aluminium oxide layer with an aqueous solution of alkali at a temperature of 35° C. to 80° C. for a period of time sufficient to remove entirely said layer from the alloy surface thereby leaving a roughened surface on the alloy sheet, and (3) subjecting the roughened surface of the alloy sheet to graining.

16. A method according to claim 15, wherein the aluminium alloy is an alloy selected from AA1XXX and AA3XXX alloys.

17. A method according to claim 15, wherein the aluminium alloy is selected from AA1050A, AA1200A and AA3103 alloys.

18. A method according to claim 15, wherein in step (1) the aluminium alloy sheet is anodised using 20% phosphoric acid containing from 3 to 15 $gl^{-1}$ aluminium at a temperature in the range of from 55° to 80° C. using a current density in the range of from 2 to 3 $kAm^{-2}$.

19. A method according to claim 15, wherein a.c. anodising is used.

20. A method according to claim 15, wherein d.c. anodising is used.

21. A method according to claim 15, wherein the layer thickness of the aluminium oxide barrier layer produced on the surface of the aluminium alloy sheet is in the range of from 10 to 50 nm.

22. A method according to claim 21, wherein the layer thickness of the aluminium oxide barrier layer is from 20 to 30 nm.

23. A method according to claim 15, wherein the aluminium oxide barrier layer is non-porous.

24. A method according to claim 15, wherein in step (2) the aqueous solution of alkali is selected from aqueous NaOH and aqueous KOH.

25. A method according to claim 24, wherein the aqueous solution of alkali has a concentration in the range of from 1 to 10%.

26. A method according to claim 25, wherein the aqueous solution of alkali is 2 to 5% NaOH.

27. A method according to claim 15, wherein in step (2) the treatment is carried out for a period in the range of from 3 to 20 seconds.

28. A method according to claim 15, wherein in step (3) graining is electrograining in nitric acid.

29. A method according to claim 15, wherein in step (3) graining is additive graining.

30. A method according to claim 29, wherein the additive graining comprises applying to the roughened surface of the aluminium alloy sheet obtained in step (2) a coating selected from sol gel coatings or films that comprise a hydrophilic and hydrophobic layer.

31. A process for producing aluminium alloy sheet having a roughened surface which process comprises the steps of (1) providing an aluminium alloy sheet the surface of which has been subjected to anodising conditions to form on the said surface an aluminium oxide barrier layer having a barrier layer thickness in the range of from 10 to 50 nm, and (2) treating the aluminium oxide layer with an aqueous solution of alkali at temperature of 35° C. to 80° C. for a period of time sufficient to remove entirely said layer from the alloy surface thereby leaving a roughened surface on the alloy sheet.

* * * * *